United States Patent [19]

Kawano et al.

[11] 4,373,679

[45] Feb. 15, 1983

[54] IMPACT TYPE CRUSHER

[75] Inventors: Yoshihiko Kawano, Honami; Hirosi Adachi, Iizuka; Masakazu Watanuki, Iizuka; Takashi Ueno, Iizuka, all of Japan

[73] Assignee: Kobukura Iron Works Co., Ltd., Fukuoka, Japan

[21] Appl. No.: 171,822

[22] Filed: Jul. 22, 1980

[30] Foreign Application Priority Data

| | | | |
|---|---|---|---|
| Jul. 23, 1979 | [JP] | Japan | 54-94671 |
| Jul. 25, 1979 | [JP] | Japan | 54-95267 |
| Jul. 26, 1979 | [JP] | Japan | 54-104570[U] |

[51] Int. Cl.[3] ..... B02C 13/09

[52] U.S. Cl. ..... 241/275

[58] Field of Search ..... 241/188 R, 194, 275, 241/292, DIG. 10

[56] References Cited

U.S. PATENT DOCUMENTS

| | | | |
|---|---|---|---|
| 3,474,974 | 10/1969 | Wood | 241/275 |
| 3,782,643 | 1/1974 | Carpenter, Jr. | 241/DIG. 10 X |
| 4,049,202 | 9/1977 | Schmidt | 241/194 X |
| 4,145,009 | 3/1979 | Fukui | 241/292 X |

FOREIGN PATENT DOCUMENTS

| | | |
|---|---|---|
| 42-11863 | 7/1967 | Japan . |
| 47-25078 | 8/1972 | Japan . |
| 48-62034 | 8/1973 | Japan . |
| 50-15659 | 5/1975 | Japan . |
| 50-23386 | 7/1975 | Japan . |
| 51-51086 | 12/1976 | Japan . |
| 52-12587 | 10/1977 | Japan . |
| 52-51333 | 11/1977 | Japan . |
| 53-70471 | 6/1978 | Japan . |
| 53-124374 | 10/1978 | Japan . |

*Primary Examiner*—Howard N. Goldberg
*Assistant Examiner*—Fred A. Silverberg
*Attorney, Agent, or Firm*—Wenderoth, Lind & Ponack

[57] ABSTRACT

A crusher of the type having a vertical rotary shaft which has a horizontal rotor secured thereto at its upper end and is rotatively mounted within the rotor frame, and mounted on the rotor is a hollow rotary cylinder with an open top end and a closed bottom, the cylinder having its peripheral wall formed with a number of raw material ejection slots so as to eject therethrough by centrifugal force the raw material to be crushed fed into it, and the rotor is further provided with a number of striking members outside the hollow rotary cylinder, preferably respectively pivoted to the rotor, for the purpose of striking the raw material ejected out of the raw material ejection slots of the hollow rotary cylinder, during the course of the flight thereof through the space around the rotary cylinder, whereby the raw material is crushed by the striking members.

15 Claims, 23 Drawing Figures

IMPACT TYPE CRUSHER

BACKGROUND OF THE INVENTION

The present invention relates to a crusher and more particularly to a crusher of the type in which the raw material is crushed by forcing it to collide with striking members or hammers revolving at a high speed within a crusher frame.

In general, there have been known two types of crushers in which a raw material is crushed by causing it to be impinged upon striking members such as striking plates, hammers, etc. revolving at a high velocity within the crusher frame, i.e. one in which the rotary shaft carrying the striking members is disposed horizontally, and another in which the rotary shaft is vertical. In both types, it is a well known fact that as the particle diameter of the raw material to be crushed becomes small the crushing of such material is made difficult. In order to carry out the crushing effectively it has been a common practice to increase the rate of rotation of the rotary shaft for the purpose of realizing a greater impact generated at the time of the collision of the raw material with the striking members. However, as the particle diameter of the raw material becomes small, the mass of the material also becomes small so that not only does the impact given thereto at the time of the collision with the striking members become small, but also, since the air surrounding the material is severely agitated by the stiking members as well as the parts supporting them which are revolving at a high velocity, the raw material having a small particle diameter can be easily accelerated by the agitated air, resulting in a decrease in the difference in velocity between the material and the striking members, thus reducing the crushing force caused by the collision. In extreme cases, it may happen that the raw material escapes sideways without impinging upon the striking members. Therefore, in the case where the particle diameter of the raw material is small, it is very difficult to effectively crush it by merely increasing the rate of rotation of the striking members. Nevertheless, it is a known fact that although the known crushers of these types have the defects as above described, they have been used more than crushers of other types, e.g. rod mills, roller mills, etc. because they are simple in construction, small in size in relation to capacity, small in the amount of space required for the installation, etc.

SUMMARY OF THE INVENTION

It is an object of the present invention to provide a crusher of the type having a vertical rotary shaft as referred to above wherein the material to be crushed having a relatively small particle diameter can be effectively crushed without the fear of being disordered by the agitated air generated by striking members rotating at a high velocity within the crusher frame together with the rotary shaft carrying the striking members.

It is another object of the present invention to provide a crusher of the type having a vertical rotary shaft as referred to above wherein the crushing of the raw material to be crushed can be easily adjusted in accordance with the particle diameter of the raw material.

It is a further object of the present invention to provide a crusher of the type having a vertical rotary shaft as referred to above wherein the striking surface of the striking member is always maintained at a predetermined position irrespective of its degree of wear until the wear progresses to a predetermined limit.

It is another object of the present invention to provide a crusher of the type having a vertical rotary shaft as referred to above wherein the raw material to be crushed is effectively crushed even if the raw material to be crushed is fed into the crusher in relatively large amounts, so that the crushing efficiency is increased.

It is a further object of the present invention to provide a crusher of the type having a vertical rotary shaft as referred to above wherein the raw material to be crushed is crushed so as to have a relatively uniform particle diameter.

It is still a further object of the present invention to provide a crusher of the type having a vertical rotary shaft as referred to above wherein the striking members have excellent wear-resistance.

In accordance with the present invention a crusher of the type referred to above is provided which comprises a frame, a vertical rotary shaft, a horizontal rotor rotatively supported at the top end of the vertical rotary shaft within the frame, a hollow rotary cylinder mounted to the upper surface of the rotor centrally thereof and having an open upper end as well as a closed bottom, the peripheral wall of the hollow rotary cylinder being formed with a number of vertical raw material ejection slots, and a number of main striking members arranged on the horizontal rotor outside the hollow rotary cylinder at a position where the raw material fed into the hollow rotary cylinder and ejected therefrom, due to centrifugal force through the raw material ejection slots, impinges thereupon.

In a preferred embodiment of the present invention the main striking members are pivoted to the horizontal rotor so that they can maintain a predetermined position relative to the rotor due to the centrifugal force applied to their center of gravity.

In accordance with one aspect of the present invention each of the main striking members comprises a number of main striking elements lying one on top of another, each having an identical configuration of relative thinness so that the element can be fully heat treated.

It is a further aspect of the present invention that the horizontal rotor mounts a number of auxiliary striking members each disposed between neighbouring main striking members so that the material to be crushed can be crushed by the main striking members in association with the auxiliary striking members.

In accordance with another preferred embodiment of the present invention a fence to repulse the raw material crushed by the main and auxiliary striking members is arranged within the crusher frame around the horizontal rotor and outside the rotation loci of the main and auxiliary striking members, whereby the space formed between the inside wall of the frame and the outside of the fence is maintained under a negative pressure so that the crushed materials which have already been crushed to a particle diameter below a predetermined diameter are sucked out of the crushing chamber to be discharged from the crusher, whereby the material to be crushed is prevented from being excessively crushed.

In a preferred form of the fence it comprises an array of bars each having a square cross-section and arranged vertically with a suitable gap being left between the respective neighbouring ones thereof.

BRIEF DESCRIPTION OF THE DRAWINGS

Other objects and advantages of the present invention will become apparent from the following description taken in conjunction with the accompanying drawings wherein are set forth by way of illustration and example certain embodiments of this invention.

FIG. 1 is a sectional view of the rotor taken along the line XI—XI of FIG. 10;

DESCRIPTION OF THE PREFERRED EMBODIMENTS

Figure 4:
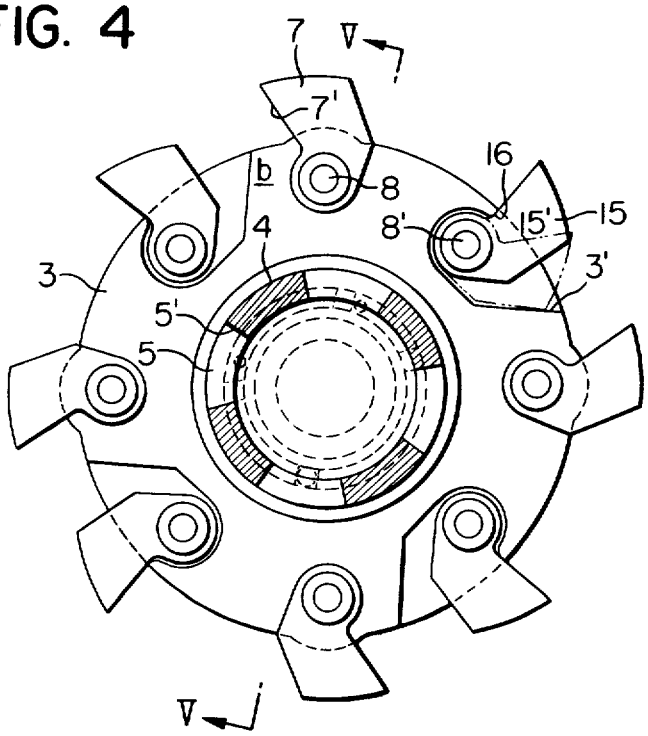
FIG. 4 is a plan view of the rotor of the crusher shown in FIG. 2 in an enlarged scale.
Figure 5:
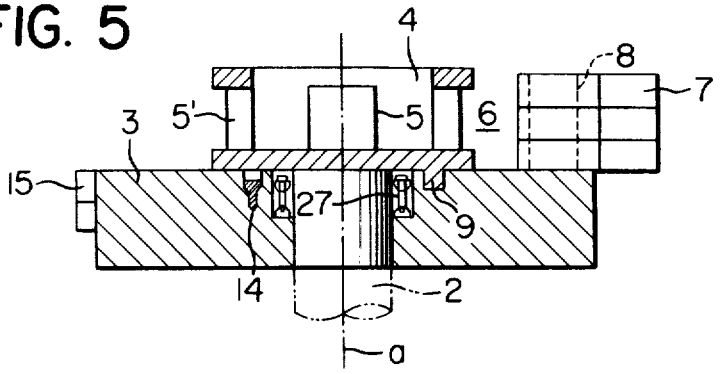
FIG. 5 is a sectional view taken along the line V—V of FIG. 4.
Figure 6:
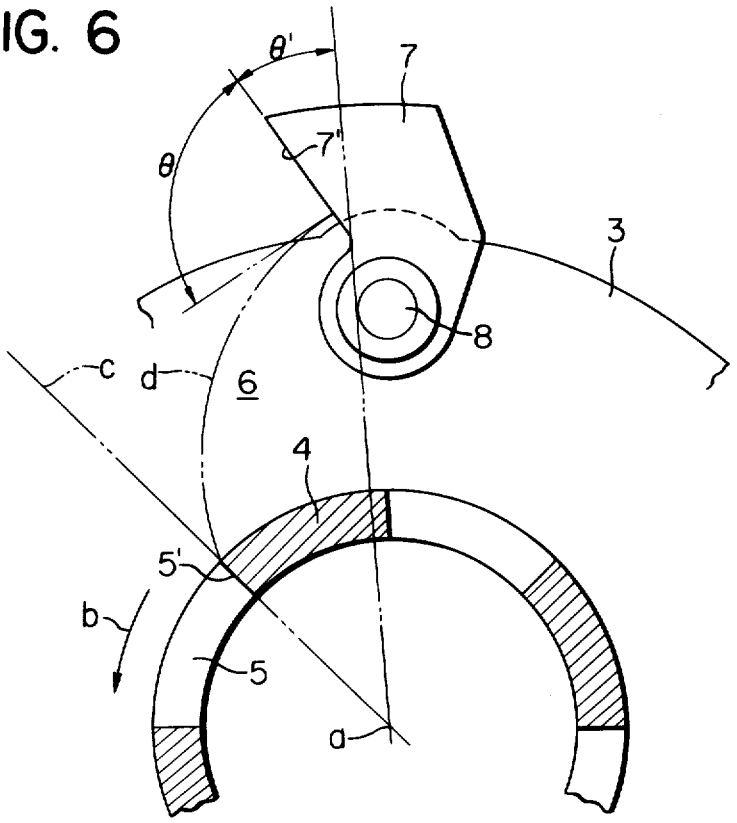
FIG. 6 is a schematical view to explain the ejection of the raw material through the raw material ejection slot formed in the wall of the hollow rotary cylinder of the crusher shown in FIGS. 3 to 5.
Figure 11:
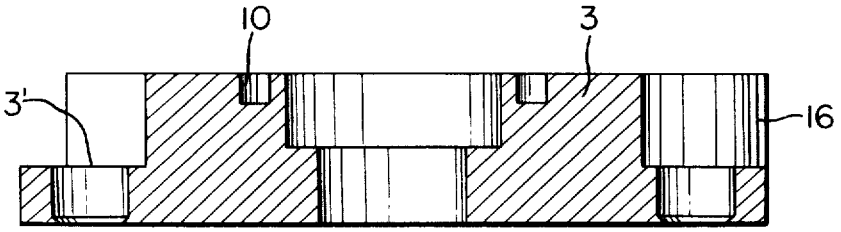
Figure 7:
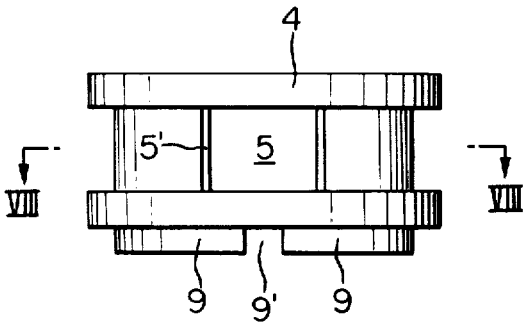
FIG. 7 is a side elevational view of the hollow rotary cylinder of the crusher shown in FIG. 2.
Figure 8:
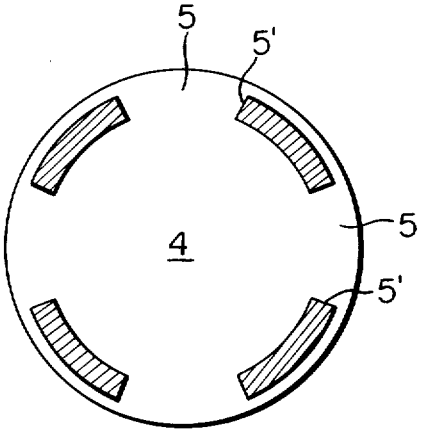
FIG. 8 is a sectional view of the hollow rotary cylinder taken along the line VIII—VIII of FIG. 7.
Figure 9:
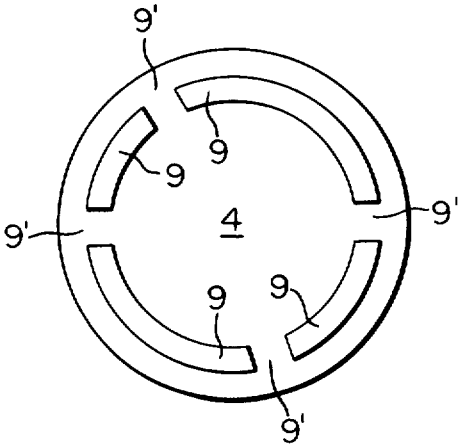
FIG. 9 is a bottom view of the hollow rotary cylinder shown in FIGS. 7 and 8.
Figure 10:
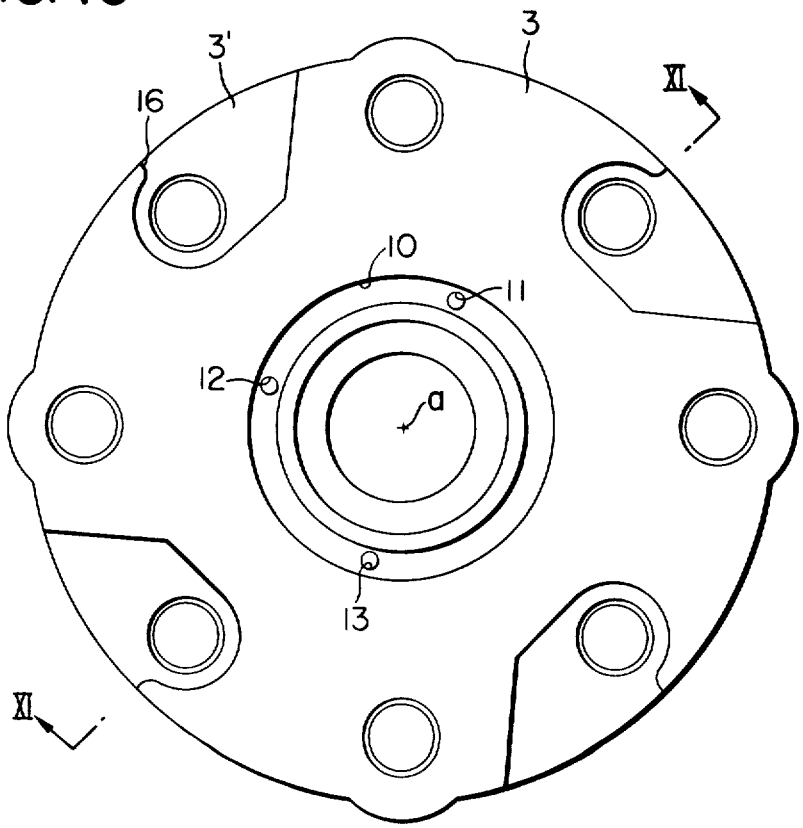
FIG. 10 is a plan view of the rotor proper with the main and auxiliary striking members being removed from the rotor shown in FIGS. 3 and 4.
Figure 12:
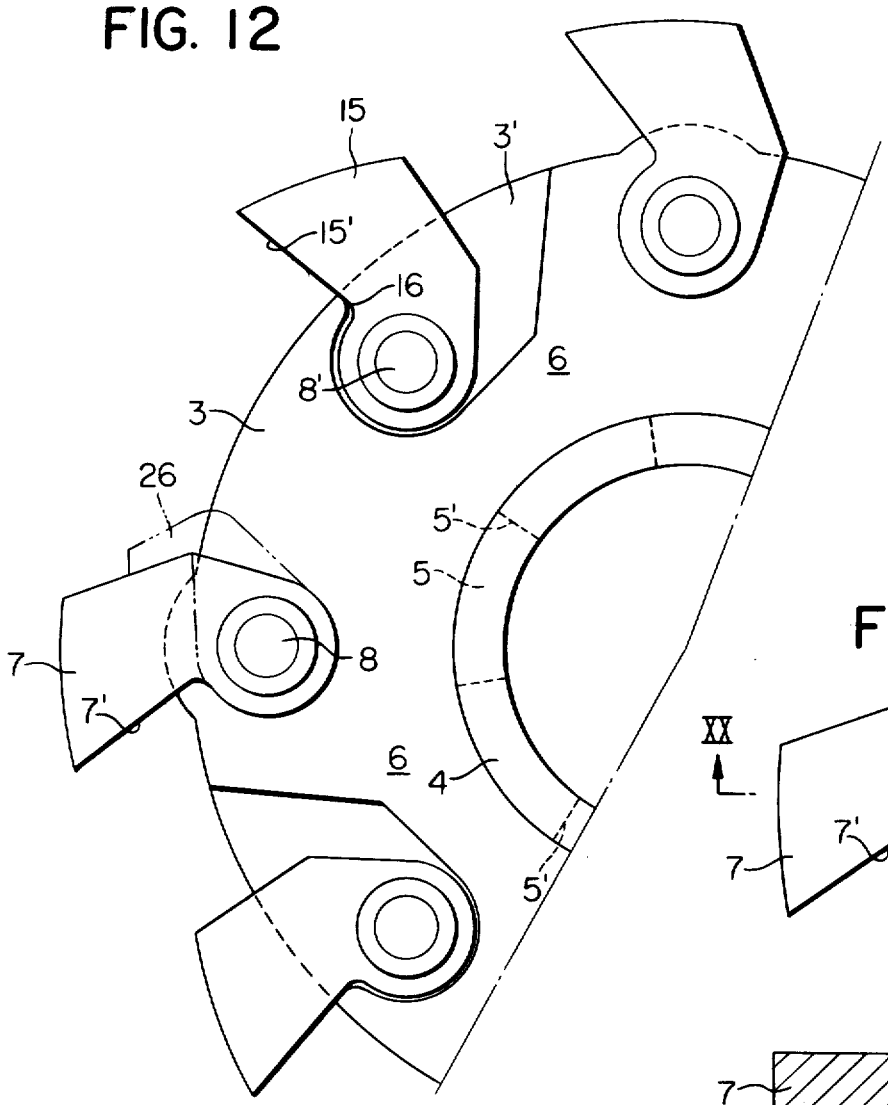
FIG. 12 is an enlarged plan view of a portion of the rotor shown in FIG. 4.
Figure 19:
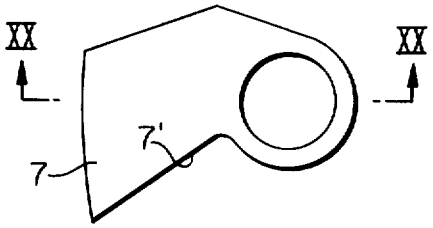
FIG. 19 is a plan view of the main striking member shown in FIG. 12.
Figure 20:
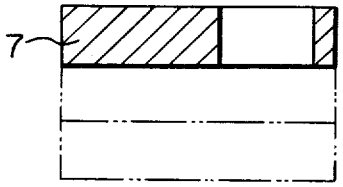
FIG. 20 is a sectional view of the main striking member shown in FIG. 12 taken along the line XX—XX of FIG. 19.

Now the first preferred embodiment of the present invention will be explained with reference to FIGS. 1 to 12 of the attached drawings. As shown in FIGS. 1 to 4, rotatively journaled within a cylindrical crusher frame 1 centrally thereof by means of bearings 31 and 32 is a vertical rotary shaft 2 to the upper end of which is fixedly secured a horizontal rotor 3 through a fixing means 27 of any known suitable design so as to have its center line aligned with the center line a of shaft 2. Mounted on rotor 3 centrally thereof is a hollow rotary cylinder 4 so as to have its center line aligned with center line a of rotor 3, cylinder 4 being opened at its upper end and closed by a bottom at its lower end, and a number of raw material discharge slots 5 are formed in the peripheral wall of cylinder 4 at substantially equiangular intervals as best shown in FIG. 5. On the upper surface of rotor 3 there are provided a number of main striking members 7 outside rotary cylinder 4, each pivoted to rotor 3 by a pin 8 vertically secured thereto, such that they are located in a rearward direction relative to the direction of rotation of rotor 3 shown by the arrow b in FIG. 6 from radial planes c passing through center line a and the raw material ejection guide surfaces 5' of raw material ejection slots 5, whereby guide surfaces 5' are formed by the side walls of slots 5, respectively facing towards direction b of rotation of rotor 3. The walls of rotary cylinder 4 are relatively narrow compared to the width of the ejection space 6 formed between cylinder 4 and main striking members 7 and the distance between each pins 8 and the outer peripheral surface of cylinder 4. Thus, it will be appreciated that when a raw material is fed onto the bottom of rotary cylinder 4 it will be ejected through slots 5 thereof by the centrifugal force applied to it so as to leave ejection guide surface 5' and freely fly in raw material ejection space 6 formed between cylinder 4 and main striking members 7 along an ejection line d as shown by the dot-and-dash line in FIG. 6 to impinge upon vertical striking surfaces 7' of main striking members 7, each facing towards direction of rotation b of rotor 3, whereby the material is crushed by impact. In this case, the angle $\theta'$ made between a radial direction of rotor 3 passing through its center line a and striking surface 7' at the time when main striking member 7 is swung about pin 8 due to the centrifugal force applied to its center of gravity during the rotation of rotor 3 is preferably selected to be between 30° and 60°, inclined forwards as viewed in the direction of rotation b of rotor 3. As shown in FIGS. 7 to 9, hollow rotary cylinder 4 is formed with a number of arcuate rib elements 9 lying on a circle on the lower surface of the bottom, respective neighbouring ribs 9 having gaps 9' left therebetween such that gaps 9' are distributed at irregular angular intervals around the center. In the upper surface of rotor 3, as shown in FIGS. 10 and 11, an annular groove 10 is coaxially formed with center line a and having a configuration corresponding to that of arcuate rib elements 9, and a number of screw threaded holes 11, 12, 13 are formed in the bottom of groove 10 at irregular angular intervals. As shown in FIG. 5, with a screw 14 being screwed into any one of screw threaded holes 11, 12, 13 and with its head being put into any one of gaps 9' formed between neighbouring rib elements 9 on the lower surface of the bottom of rotary cylinder 4, the relative position between raw material ejection guide surface 5' of raw material ejection slots 5 formed in the peripheral wall of rotary cylinder 4 and main striking members 7 can be adjusted. The angle $\theta$ at which the ejected raw material impinges upon striking surface 7' of main striking member 7 as shown in FIG. 6 is preferably between 60° and 85°. As shown in FIGS. 4 and 12, in addition to striking members 7 arranged on the upper surface of rotor 3 on a circle near its outer periphery at equi-angular intervals, there are arranged also auxiliary striking members 15 on rotor 3 alternately so as to be swingable about pins 8' secured to rotor 3 in a circle, each of auxiliary striking members 15 having a vertical striking surface 15' which extends substantially in the radial direction of rotor 3 and is inclined rearwards relative to the direction of rotation b of rotor 3, whereby auxiliary striking member 15 is disposed within respective indented regions 3' formed in the upper surface of circular rotor 3 which region 3' has a stopper 16 at the position where striking surface 15' meets, shaped so as to prevent auxiliary striking member 15 from swinging towards the direction of rotation b of rotor 3. At this point it should be noted that raw material ejection space 6 referred to above means in the embodiment shown that no guide element exists to guide the ejected raw material between raw material ejection guide surfaces 5' of raw material ejection slots 5 of hollow rotary cylinder 4 and striking surfaces 7' of main striking members 7, and after the raw material ejected through slots 5 flies freely into this space 6 along ejection line d as shown in FIG. 6, it impinges upon striking surfaces 7'.

Figure 1:
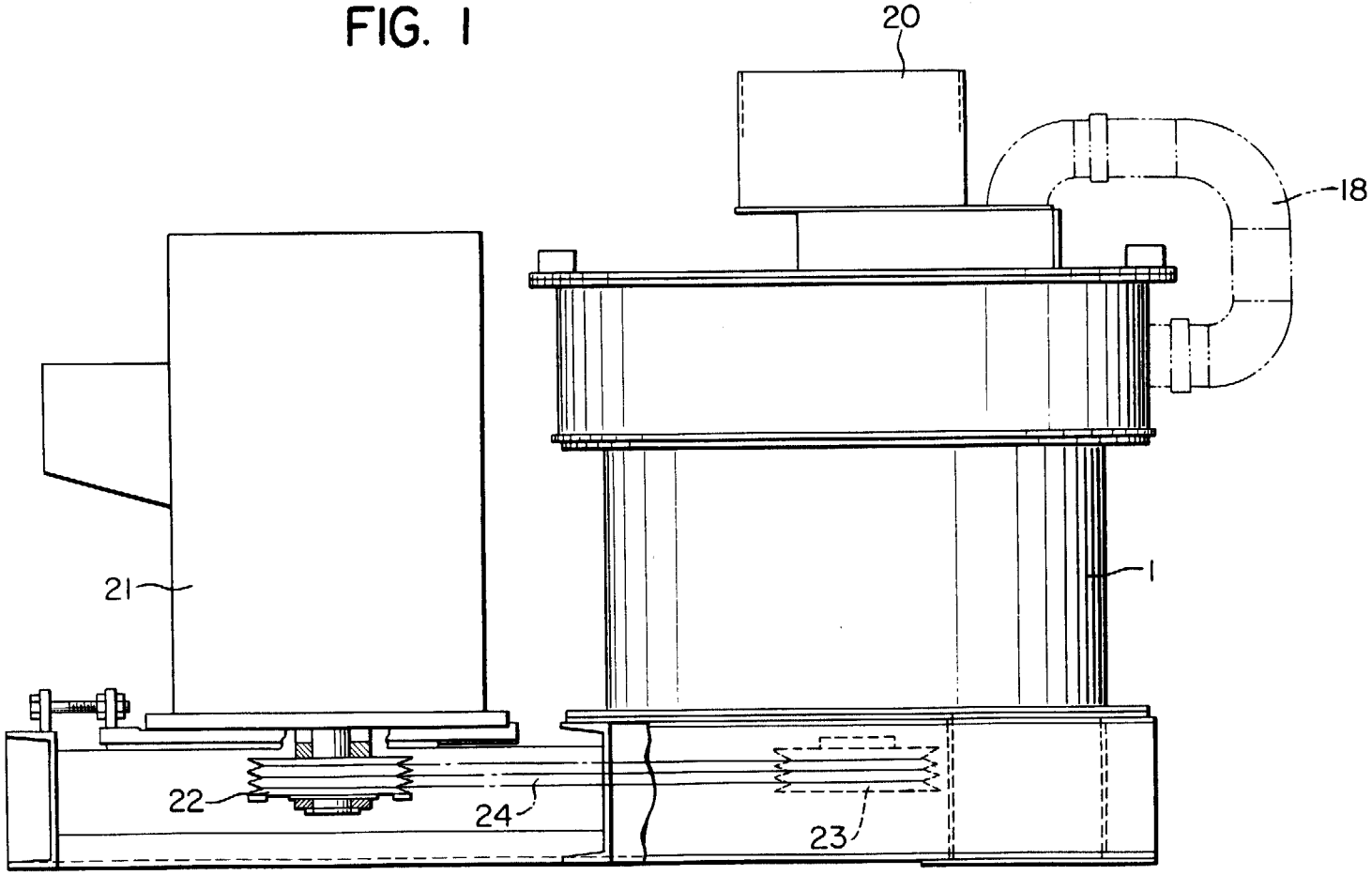
FIG. 1 is a side elevational view of one embodiment of the present invention, partly broken away.
Figure 2:
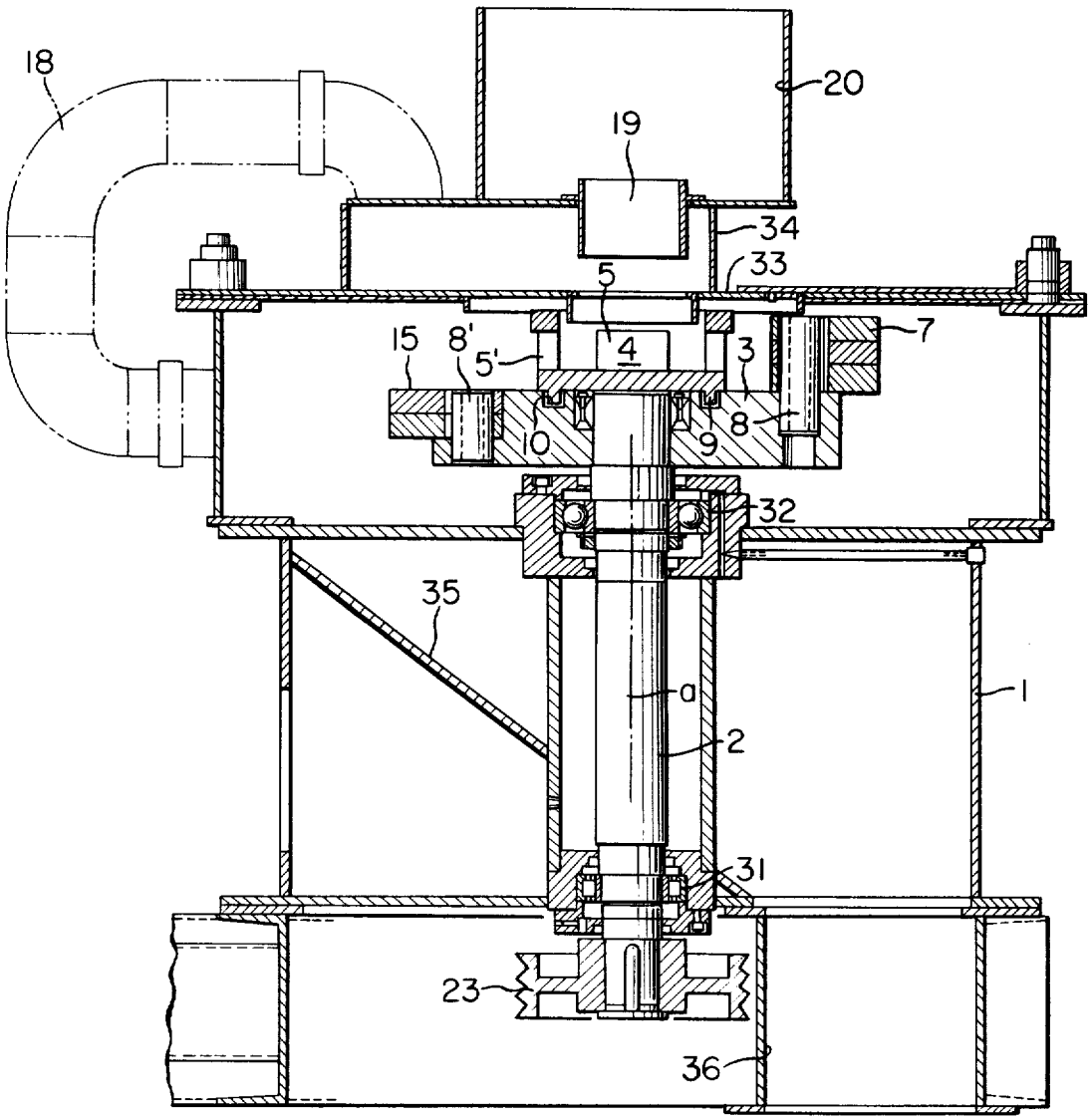
FIG. 2 is a longitudinal sectional view of the crusher shown in FIG. 1.
Figure 3:
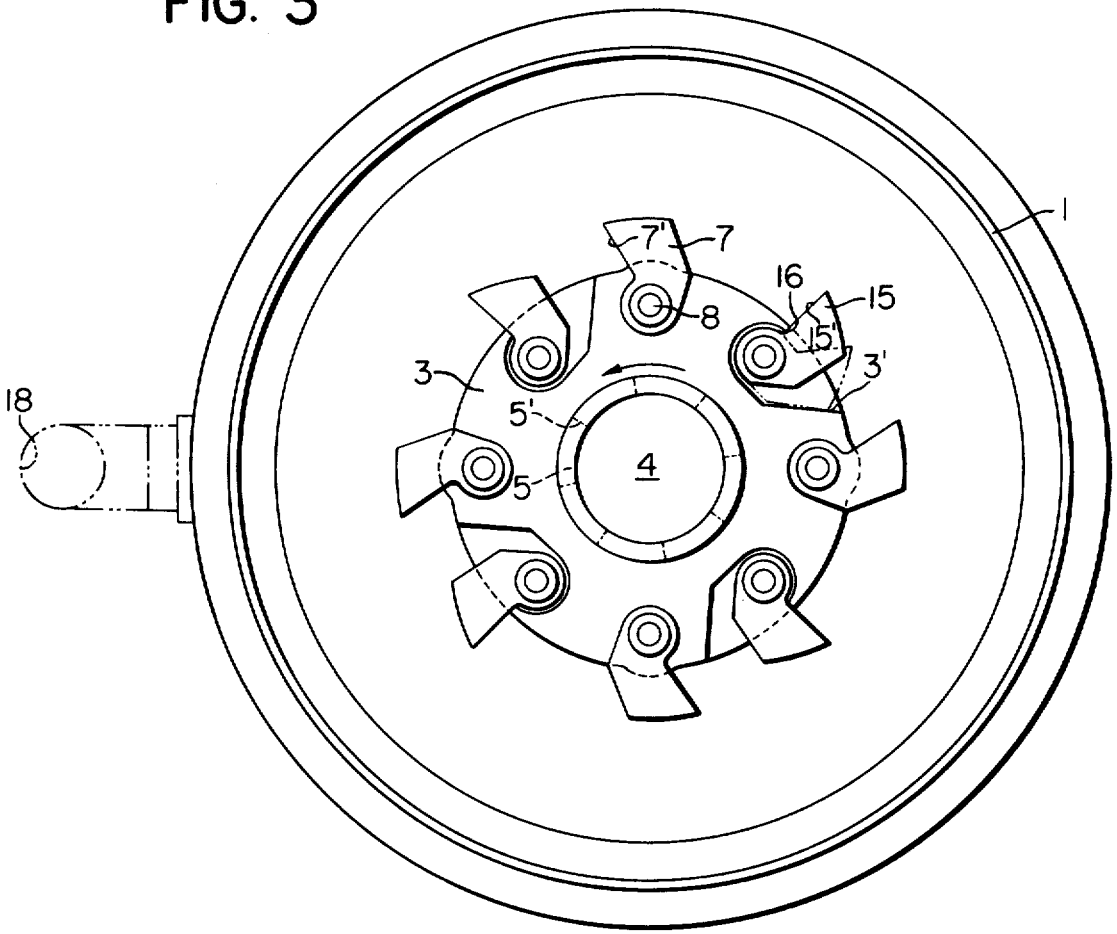
FIG. 3 is a plan view of the crusher shown in FIG. 2 as viewed from above with the top plate of the crusher frame taken away.

As shown in FIG. 2 a cover 33 detachably mounted to the upper end of crusher frame 1 is provided with a flat cylindrical casing 34 on its surface somewhat eccentrically of the center line a of shaft 2 with a raw material supply orifice 19 being opened in its top plate in alignment with center line a, a raw material hopper 20 being secured to the top plate of casing 34 coaxially with raw material supply orifice 19 so as to surround it. The upper portion of crusher frame 1 and the top plate of flat cylindrical casing 33 may be connected by an ejection air suction duct 18, if required, as in the second embodiment to be explained later. As shown in FIGS. 1 and 2 shaft 2 is adapted to be driven by a prime mover 21 arranged in a side-by-side relationship with crusher frame 1 on a common base through a pulley 23 mounted on shaft 2 at its lower end, a pulley 22 mounted to the output shaft of prime mover 21 and endless belts 24 reeved on pulleys 22, 23. Further, a crushed material guide plate 35 is mounted within crusher frame 1 below rotor 3 obliquely so as to extend substantially from the upper peripheral portion of frame 1 to the lower central portion thereof where a discharge orifice 36 is provided vertically through the common base.

The operation of the crusher the constitution of which has been explained so far will now be described fully.

Figure 13:
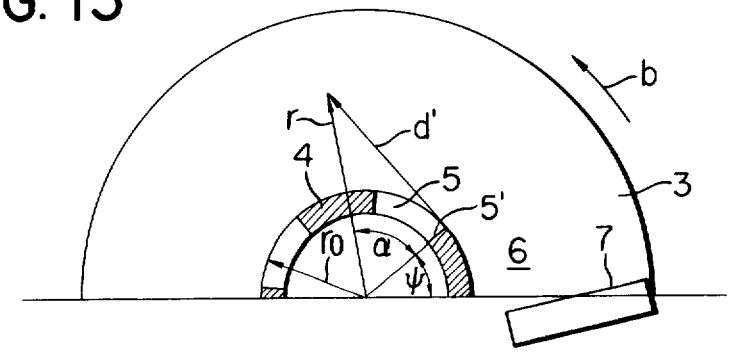
FIG. 13 is a schematical view similar to FIG. 6 to explain the ejection of the raw material through the raw material ejection slot.

Upon starting the drive of prime mover 21, rotor 3 is rotated at high speed in the direction shown by the arrow b in FIG. 6 through pulleys 22, 23, belts 24 and vertical rotary shaft 2. When the raw material having a relatively small diameter, say, smaller than about 40 mm is supplied to hollow cylindrical rotor 4 through raw material supply orifice 19 via hopper 20, it comes into contact with the bottom surface of hollow rotary cylinder 4 and is thereby given a rotational force around center line a, whereby it is ejected through raw material ejection guide surfaces 5' of raw material ejection slots 5 of rotary cylinder 4 due to the centrifugal force, into raw material ejection space 6. The raw material thus ejected flies in space 6 along ejection line d shown by the dot-and-dash line in FIG. 6 and impinges upon striking surfaces 7' of main striking members 7, maintaining impinging angle $\theta$ therebetween as shown in FIG. 6, whereby the raw material is crushed. Since striking surface 7' is located outside raw material ejection slots 5 of cylinder 4, the peripheral velocity centered at center line a of striking surfaces 7' is larger than that of ejection guide surfaces 5', so the raw material ejected from guide surfaces 5' flies out therefrom into raw material ejection space 6 and impinges upon striking surfaces 7' of main striking members 7 which are moving at a faster peripheral velocity. In this case the locus of the raw material ejected from guide surfaces 5' to fly out into space 6 is substantially constant regardless of the rate of rotation of rotor 3, that is, the locus being in a direction substantially tangential to the outer periphery of hollow rotary cylinder 4 after the raw material leaves guide surfaces 5' as shown by the arrow d' in FIG. 13, and striking surfaces 7' which are moving at a high peripheral velocity impinge upon the raw material which flies along locus d'. The position on striking surfaces 7' at which the raw material impinges thereupon can be adjusted by changing the position of raw material ejection slots 5 or raw material ejection guide surfaces 5' relative to that of main striking members 7. Thus, after the raw material impinges upon striking surfaces 7' near the boss of main striking members 7, it rolls on them to their tip and is thrown towards the inner surface of crusher frame 1. Since the peripheral velocity of the portion near the boss of main striking surface 7' is less than that of the tip the crushing force at the former is less than that at the latter, so there arises the effect that the shape of the crushed particle is made nearly spherical by causing it to be rolled on striking surfaces 7'. Contrarily, if the raw material impinges upon striking surfaces 7' near their tip end, although it is subjected to a greater crushing force, the effect that the crushed particle is made spherical in shape can not be expected. Therefore, the part at which the raw material impinges upon striking surfaces 7' can be selected according to whether it is a greater crushing force or a better shape of the crushed particle that it is desired to obtain.

Figure 14:
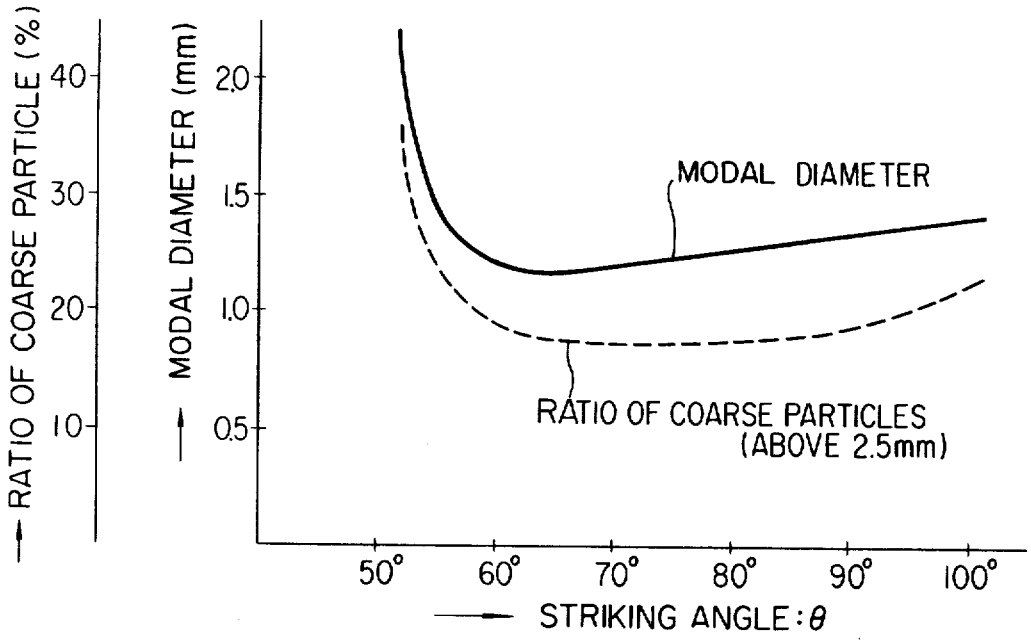
FIG. 14 is a diagram representing the results of experiments made with the crusher shown in FIG. 1.

As shown in FIG. 14 which expresses the results of experiments made with the crusher so far explained, it is clear that, when angle $\theta$ at which the raw material impinges upon striking surfaces 7' is somewhat acute outwardly, relative to the direction of rotation b of rotor 3 as shown in FIG. 6, if angle $\theta$ falls between 60° and 85° rather than being 90°, the proportion of particles with a diameter larger than 2.5 mm is small and yet the modal diameter is small, demonstrating effective crushing.

As to striking surfaces 15' of auxiliary striking members 15 which are arranged on rotor 3 in its indented regions 3' below main striking members 7 and rearwardly of main striking members 7 with regard to the direction of rotation b of rotor 3, they have the purpose of crushing the raw material which has not been crushed by striking surfaces 7' of main striking members 7, i.e. if the raw material is fed to rotary cylinder 4 in excessive amounts, the raw material thrown into raw material ejection space 6 after being ejected from raw material ejection guide surfaces 5' has its ejection energy merely damped by impinging upon striking surfaces 7' in layers, without being crushed, but during its fall under the influence of gravity it impinges upon striking surfaces 15' of auxiliary striking members 15 to be crushed by them.

It is needless to say that the striking angle $\theta$ made between striking surfaces 7' of main striking members 7 and the raw material impinging upon them is maintained by centrifugal force applied to main striking members 7 at their center of gravity.

Next another embodiment of the present invention will be explained with reference to FIGS. 15 to 18.

This embodiment is substantially identical in constitution to that of the first one except in that in this embodiment a raw material repulsion fence 112 is arranged within the upper portion of crusher frame 1 so as to surround rotor 3 outside the rotating loci of main striking members 7 and auxiliary striking members 15. Therefore, in FIGS. 15 to 18 like numerals refer to like parts in the first embodiment. Fence 112 comprises a number of vertical bars 114 each having a square cross-section and arranged in a circle at equi-intervals, whereby bars 114 are swingably supported between an upper and a lower support rings 116, 116 with upper and lower pins 114', 114' projected outwards centrally of each of bars 114 at its upper and lower ends being rotatively fitted within corresponding openings 117, 117 formed in upper and lower support rings 116, 116. Further, a serrated ring plate 115 having a number of serrations formed around its inner periphery is fixedly secured to crusher frame 1, the number of serrations corresponding to that of bars 114, and the configuration of each of them is so formed that when serrated ring plate 115 is fixedly disposed close to bars 114 outwards thereof the serration can maintain one of the four faces of each of bars 114 substantially towards the moving direction of the raw material repulsed by main striking members 7 and auxiliary striking members 15, whereby a sorting or screening slit t is left between respective adjoining bars 114. The shape of slit t should preferably widen, in the downwards direction.

In the present embodiment, upon rotation of rotary shaft 2 through prime mover 21, the raw materials fed to the bottom of hollow rotary cylinder 4 through raw material hopper 20 and raw material supply orifice 19 are ejected in a direction tangential to the outer periphery of cylinder 4 through raw material ejection slots 5 due to centrifugal force and are crushed by main striking members 7 and auxiliary striking members 15, whereby the crushed raw material repulsed by them impinges upon fence 112 so that material having a larger dimension is additionally crushed again. In this case, the generated finely crushed particles are sucked through sorting slits t formed between respective neighbouring bars 114 due to the negative pressure prevailing in the space between the inner wall of crusher frame 1 and the outer periphery of fence 112 as explained later and discharged out of crusher frame 1 by any suitable means not shown. In this case, such negative pressure is generated by duct 18 which connects the space around fence 112 to flat cylindrical casing 34 and acts to induce a negative pressure due to the negative pressure existing within hollow rotary cylinder 4. Alternatively, a suction blower or the like may be connected to the upper portion of crusher frame 1 to maintain the space around fence 112 in a negative pressure condition.

In this embodiment, if the one face of any of bars 114 is subjected to excessive wear at its upper part it may continue to be used by having it upper and lower sides reversed. Therefore, each of the 4 faces of bars 114 may be used twice for a total of eight applications of the one bar.

Thus, it will be appreciated that this embodiment makes it possible to carry out the more effective crushing of raw materials, and at the same time the prevention of excessive crushing is assured. In addition, the use of bars with a square cross-section as the repulsion fence reduces clogging and increases the life of the fence.

In the two embodiments shown and explained above, main and/or auxiliary striking members 7, 15 may comprise a number of relatively thin striking elements as shown or suggested in FIGS. 2, 5 and 19 to 23 instead of being constituted integrally. Since the striking elements have respectively a similar shape such that the centers of gravity thereof coincide, when they are subjected to centrifugal force, they occupy respectively exactly the same position relative to pins 8 or 8'. During the operation of the crusher main or auxiliary striking members 7 or 15 have their striking surfaces 7' or 15' subjected to wear due to the impinging of raw materials. In this case, assuming that striking members 7 or 15 comprise three striking elements, it is generally true that the striking surface of the middle element has a much higher possibility of impinging the raw materials than one located above or below it. Therefore, the striking surface of the middle element is subjected to greater wear than the others. In this case, the middle element may be replaced by the one above or below.

It is inevitable that the striking surfaces of the striking members will become worn out. In order to resist wear the striking member has customarily been made of a material which can be hardened by heat treatment. However, in this case, the cooling during the process of heat treatment is difficult when the depth from the surface is great, resulting in poor hardening.

By constituting a striking member from a number of striking elements such that these are arranged one upon another as stated above, each of the elements may be relatively thin so that its striking surface can be sufficiently hardened in all parts. Further, since it is usual that among the striking elements one disposed intermediately is subjected to greater wear than others, when it has been worn out by more than a predetermined value, it is necessitated only that the worn out element be replaced by a new one or by one of those disposed above or below it, otherwise, when a specific portion of a striking surface of a striking member has worn out, the striking member itself would have to be discarded as a whole. Thus, this constitution of a striking member exhibits substantial economy in terms of material.

Figure 22:
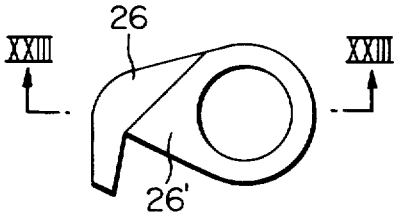
FIG. 22 is a plan view of a supplemental weight to be cooperated with the main striking member shown in FIG. 21.
Figure 21:
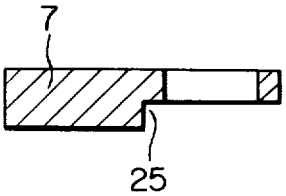
FIG. 21 is a sectional view similar to FIG. 20 of a modified main striking member.
Figure 23:
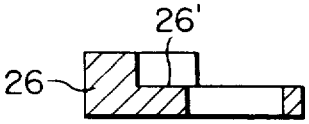
FIG. 23 is a sectional view of the supplemental weight shown in FIG. 22 taken along the line XXIII—XXIII of FIG. 22.
Figure 15:
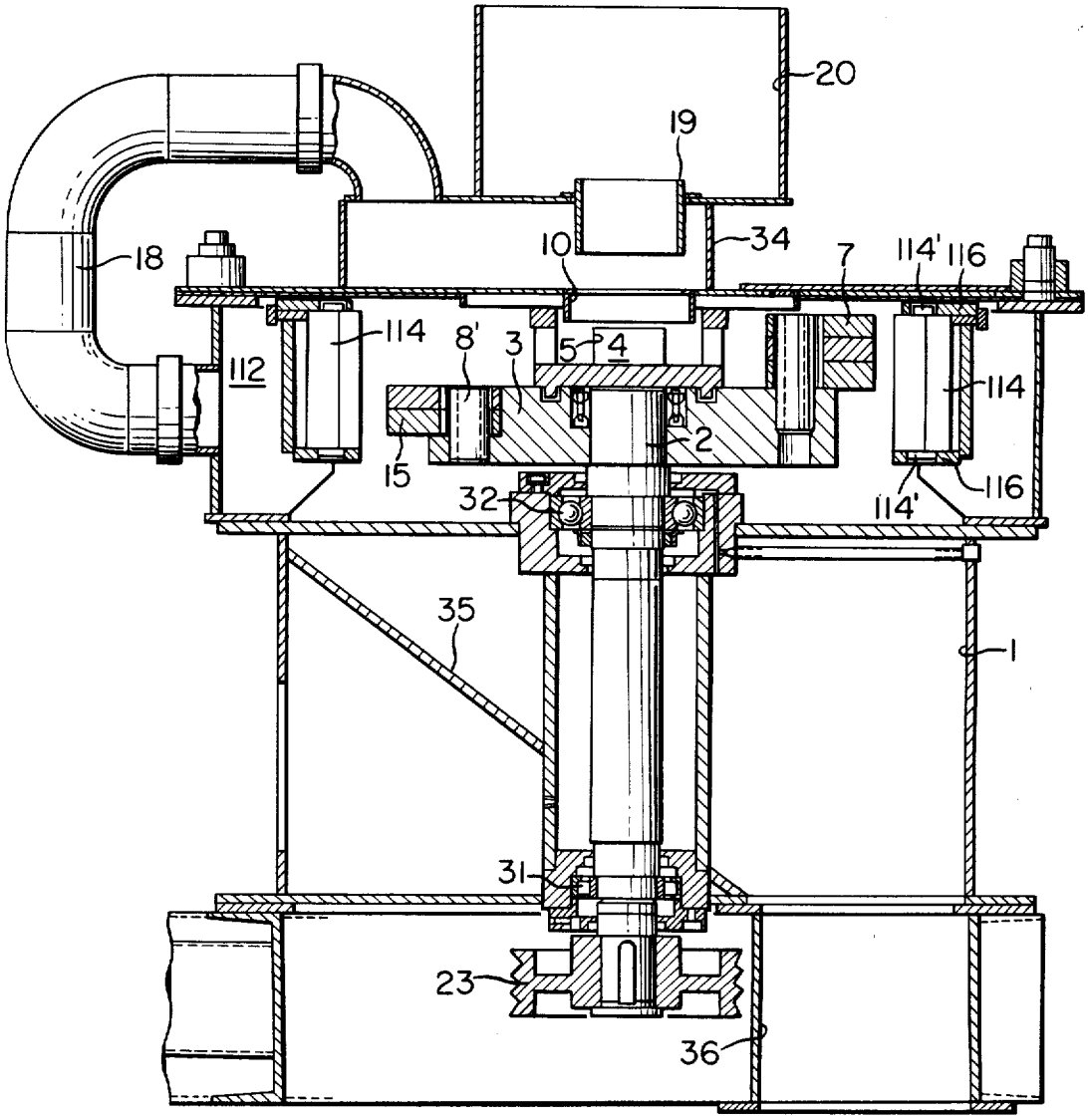
FIG. 15 is a longitudinal sectional view of another embodiment of the crusher according to the present invention.
Figure 16:
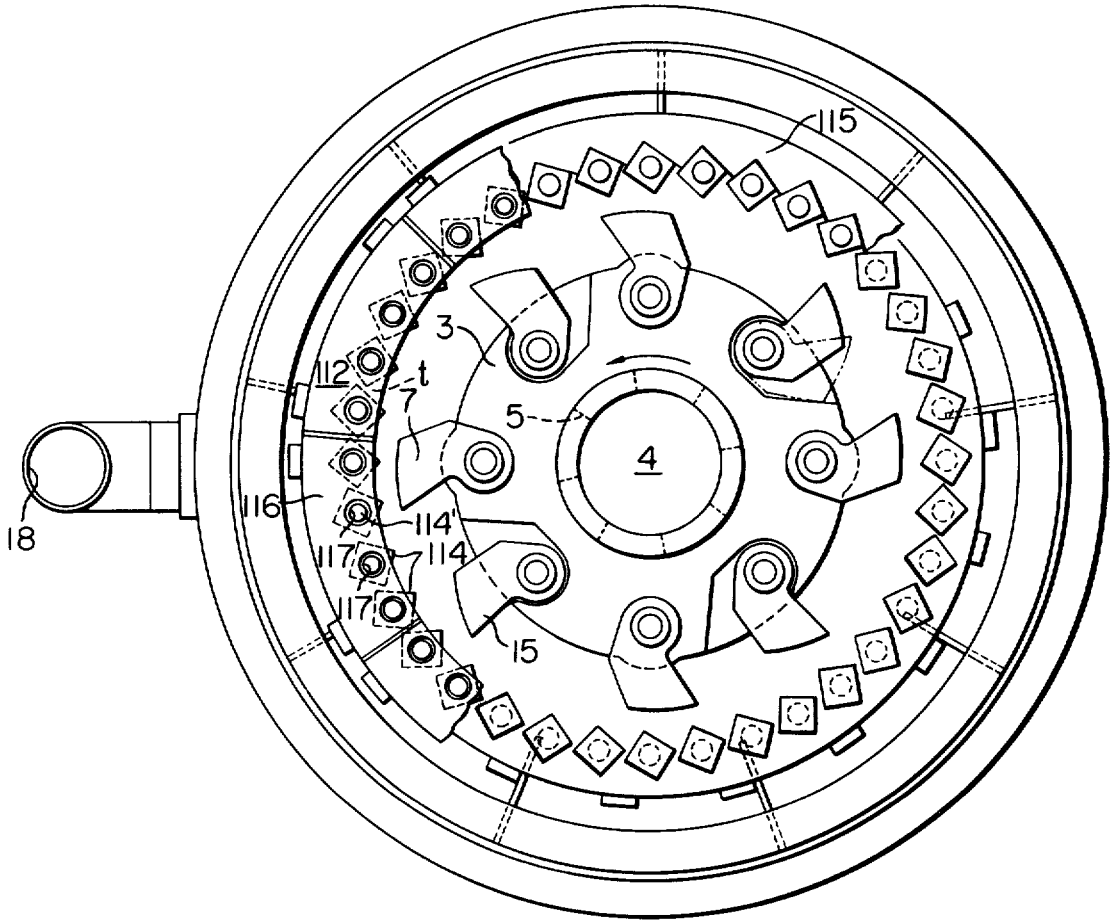
FIG. 16 is a plan view of the crusher shown in FIG. 15 as viewed from above with the top plate of the crusher frame taken away.
Figure 17:
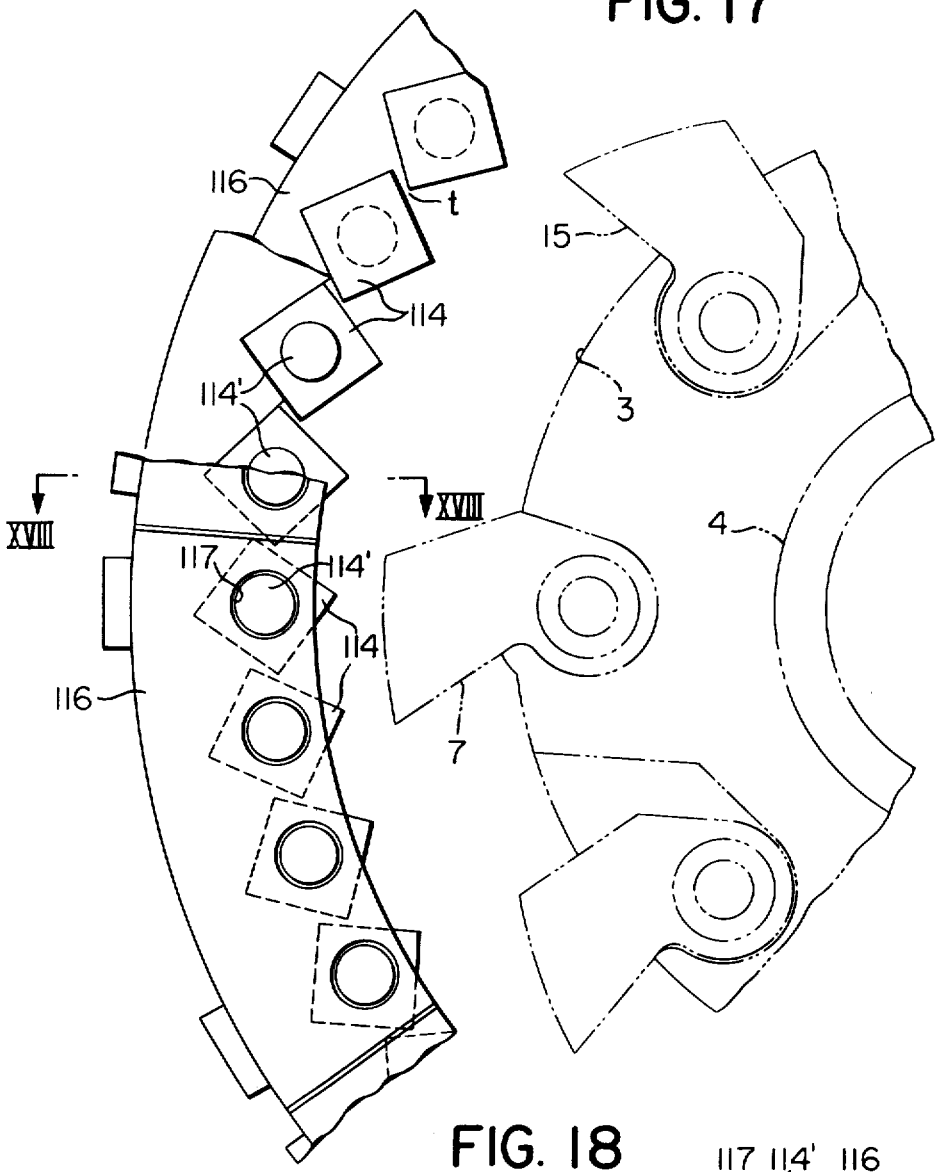
FIG. 17 is an enlarged plan view of a part of the raw material repulsing fence shown in FIG. 16.
Figure 18:
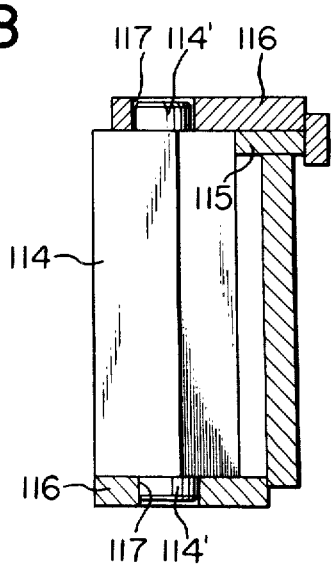
FIG. 18 is a sectional view of the raw material repulsing fence shown in FIG. 17 taken along the line XVIII—XVIII of FIG. 17.

Further, as shown in FIGS. 12, 22 and 23 striking member 7 may have a supplemental weight 26 detachably mounted thereto for the purpose of the adjustment of the position of the center of gravity.

From the foregoing, it will be apparent that according to the present invention, such various excellent effects as explained below can be obtained.

1. Raw material with a relatively small particle size can impinge strongly upon the striking surfaces of the main striking members in an orderly way regardless of the rate of rotation of the rotor, without being in danger of being subjected to disorder due to air turbulence caused by the revolving striking members, so that fine particles can be obtained, i.e. the crushing efficiency is remarkably improved, the yield of the crushed material with a fine particle diameter being increased.

2. Since the relative position between the raw material ejection guide surfaces of the raw material ejection slots of the hollow rotary cylinder and the striking members can be adjusted, the raw material can be made to impinge upon the striking surfaces at either the outer end portion or inner end portion thereof, depending upon the particle size of the crushed material to be obtained, so that the crushing can be carried out at will depending upon the object of the crushing, being such as that the raw material is to be crushed to have a fine particle size, or that the shape of the particle of the crushed material is due consideration, etc.

3. The width of the loci of the raw materials ejected from the hollow rotary cylinder differs depending upon the amount of raw materials fed in, and, when the outer periphery of the width comes off the outer end of the striking surfaces of the striking members, it is possible that the raw materials are made to impinge with certainty upon the striking surfaces by controlling the outer margin of the loci of the raw materials with the position of the hollow rotary cylinder being adjusted relative to that of the striking members depending upon the amount of the materials fed in. Further, the relative position between the striking members and the hollow rotary cylinder can be similarly adjusted depending upon the wear of the raw material ejection guide surfaces of the raw material ejection slots of the hollow rotary cylinder.

4. The impinging angle $\theta$ made between the impinging raw materials and the striking surfaces can be made optimum so that the crushing efficiency can be improved.

5. Since the striking surfaces of the striking members are maintained by having the striking members swingably supported by the pins so that centrifugal force is applied to the center of gravity of the striking members the maintaining of the striking surfaces at their optimum position is made quite easy. The recession of the striking surfaces of the striking members due to their wear makes the center of gravity of the striking members recede so that the striking surfaces are automatically advanced by an amount corresponding to half the amount of wear. A further advancing of the striking surfaces can be effected by mounting or dismounting the supplemental weights as appropriate. The mounting of the striking members by pins 8 so as to be swingable therearound eliminates the fear of the destruction of the striking members due to striking against some uncrushable foreign matter is, so the safety of the striking members is enhanced.

6. The auxiliary striking members catch the non-crushed raw materials and can crush them. Therefore, the crushing efficiency of the raw material can be considerably improved even if the amount of raw material fed in is large.

7. By the provision of the raw material repulsion fence around the rotor the excessive crushing of the raw material can be effectively prevented.

8. By constituting the main and auxiliary striking members so as to respectively comprise a number of striking elements each having a relatively thin plate-like configuration, each of the striking elements can be heat treated throughly so that it can be fully hardened, thereby resisting wear. And, if any one of the striking elements wears out to a predetermined value, it is necessary only that the worn out element alone has to be replaced by a new one or exchanged with another element that has not yet been subjected to such a degree of wear. This makes it possible to not have to replace the whole lot of the main or auxiliary striking members, as is required when they are respectively constituted as an integral body.

It will be apparent to those skilled in the art that various changes in the structure and relative arrangement of parts may be made without necessarily departing from the scope of the present invention as defined in the claims appended.

What is claimed is:

1. A crusher comprising a frame having a substantially closed hollow cylindrical form with a raw material supply orifice being formed in its upper wall, a vertical rotary shaft rotatively supported within said frame below said raw material supply orifice, a horizontal motor mounted within said frame at the upper end of said rotary shaft for rotation in a rotational direction, a hollow rotary cylinder having a peripheral wall mounted within said frame to the upper surface of said rotor centrally thereof, said hollow rotary cylinder having an outer peripheral surface spaced from the inner cylindrical surface of said frame, being opened at its upper end below said raw material supply orifice and having a bottom closing its bottom end, said peripheral wall of said hollow rotary cylinder having at least one slot for ejecting therethrough by centrifugal force into an ejection space raw material fed onto said bottom, and at least one main striking member mounted to said rotor outside said hollow rotary cylinder, spaced from said outer peripheral wall of said hollow rotary cylinder to define therebetween the cylindrical raw material ejection space, the radial width of said ejection space being much greater than the thickness of said peripheral wall and having a striking surface facing towards said rotational direction of said rotor such that said raw material ejected through said slot impinges upon said striking surface during its movement through said raw material ejection space.

2. A crusher as claimed in claim 1 wherein said hollow rotary cylinder is mounted to said rotor so as to have the position of said slot relative to said main striking member adjustable.

3. A crusher as claimed in claim 1 wherein said main striking member is pivotably mounted to said rotor so that said striking surface is maintained at a substantially constant angle in relation to the impinging direction of said raw material when said main striking member is pivoted by centrifugal force applied to its center of gravity due to the rotation of said rotor.

4. A crusher as claimed in claim 3 wherein said constant angle is somewhat acute when it is measured in the radial direction of said main striking surface.

5. A crusher as claimed in claim 4 wherein said constant angle is between 60° and 85°.

6. A crusher as claimed in claim 3 wherein said at least one main striking member comprises means for detachably mounting a supplemental weight to adjust the location of said center of gravity.

7. A crusher as claimed in claim 1 wherein said rotor is additionally provided with at least one auxiliary striking member having a striking surface facing towards the direction of rotation of said rotor, said at least one auxiliary striking member being located rearward of said at least one meain striking member in relation to said direction of rotation of said rotor.

8. A crusher as claimed in claim 7 wherein said at least one auxiliary striking member comprises a plurality of auxiliary striking elements each having a thin plate-like form.

9. A crusher as claimed in claim 1 further comprising a raw material repulsion fence arranged within said frame surrounding said rotor and spaced from the locus of rotation of said main striking member as well as the inner wall of said frame.

10. A crusher as claimed in claim 9 wherein said raw material repulsion fence comprises an array of bars arranged substantially vertically with a gap being left between the respective neighbouring one of said bars.

11. A crusher as claimed in claim 10 wherein each of said bars has a square cross-section.

12. A crusher as claimed in claim 9 further comprising means for maintaining the space between the inner wall of said frame and said raw material repulsion fence under a negative pressure.

13. A crusher as claimed in claim 12 wherein said negative pressure maintaining means comprising duct means for connecting said space to said raw material supply orifice through said frame, said orifice being opened in the upper wall of said frame near the opened upper end of said hollow rotary cylinder.

14. A crusher as claimed in claim 1, 7 or 9 wherein said at least one main striking member comprises a plurality of main striking elements put one upon another, each of said plurality of main striking elements having a thin plate-like form.

15. A crusher comprising a frame having a substantially closed hollow cylindrical form with a raw material supply orifice being formed in its upper wall, a vertical rotary shaft rotatably supported within said frame below said raw material supply orifice, a horizontal rotor mounted within said frame at the upper end of said rotary shaft for rotation in a rotational direction, a hollow rotary cylinder mounted within said frame to the upper surface of said rotor centrally thereof, said hollow rotary cylinder having an outer peripheral wall spaced from the inner cylindrical surface of said frame to define therebetween a cylindrical raw material ejection space, said hollow rotary cylinder being opened at its upper end below said raw material supply orifice and having a bottom for closing its bottom end, said peripheral wall of said hollow rotary cylinder having at least one slot for ejecting therethrough by centrifugal force into said ejection space raw material fed onto said bottom, at least one main striking member mounted to said rotor outside said hollow rotary cylinder and having a striking surface facing toward said rotational direction of said rotor such that said raw material ejected through said slot impinges upon said striking surface during its movement through said raw material ejection space, a raw material repulsion fence arranged within said frame surrounding said rotor and spaced from the loci of rotation of said main striking member and the inner wall of said frame, and means for maintaining the space between the inner wall of said frame and said raw material repulsion fence under a negative pressure, said negative pressure maintaining means comprising duct means for connecting said space to said raw material supply orifice through said frame.

* * * * *